US007411133B2

(12) United States Patent
Morgan et al.

(10) Patent No.: US 7,411,133 B2
(45) Date of Patent: Aug. 12, 2008

(54) METHOD FOR RETAINING A POWER CORD

(75) Inventors: Charles Jeff Morgan, Long Beach, MS (US); Christopher M. Paterson, Biloxi, MS (US); Steven Philip Irby, Gulfport, MS (US); Paul A. Moshenrose, Ocean Springs, MS (US)

(73) Assignee: Oreck Holdings LLC, Cheyenne, WY (US)

( * ) Notice: Subject to any disclaimer, the term of this patent is extended or adjusted under 35 U.S.C. 154(b) by 42 days.

(21) Appl. No.: 11/446,902

(22) Filed: Jun. 5, 2006

(65) Prior Publication Data

US 2006/0218746 A1 Oct. 5, 2006

Related U.S. Application Data

(62) Division of application No. 10/410,004, filed on Apr. 9, 2003.

(51) Int. Cl.
*H02G 3/04* (2006.01)

(52) U.S. Cl. ..... 174/135; 174/10; 174/13; 174/481; 174/64; 15/410

(58) Field of Classification Search ..... 174/47, 174/46, 135, 10, 13, 73.1, 50, 481, 493, 64, 174/659, 660, 665, 68.1; 248/56, 68.1; 439/445, 439/455; 15/339, 350, 410, 323
See application file for complete search history.

(56) References Cited

U.S. PATENT DOCUMENTS

| | | | | | |
|---|---|---|---|---|---|
| 1,348,585 | A * | 8/1920 | Rosenfield | 15/355 |
| 2,183,310 | A | 12/1939 | Frantz | |
| 2,521,226 | A * | 9/1950 | Keller | 242/395 |
| 2,926,369 | A * | 3/1960 | Holt | 15/49.1 |
| 2,946,071 | A * | 7/1960 | Nilsson | 15/22.1 |
| 3,251,107 | A * | 5/1966 | Scott | 24/134 R |
| 3,350,858 | A * | 11/1967 | Verhagen | 55/376 |
| 4,133,971 | A | 1/1979 | Boyd et al. | |
| 4,162,370 | A | 7/1979 | Choiniere et al. | |
| 5,318,158 | A | 6/1994 | Seasholtz et al. | |
| 6,446,304 | B1 * | 9/2002 | Paterson et al. | 15/410 |
| 6,484,349 | B1 * | 11/2002 | Paterson et al. | 15/323 |
| 6,824,170 | B2 * | 11/2004 | Lee | 285/92 |
| 2004/0164033 | A1 * | 8/2004 | Reyniers | 210/800 |

FOREIGN PATENT DOCUMENTS

DE 9107516 U1 10/1992

* cited by examiner

*Primary Examiner*—Dhiru R Patel
(74) *Attorney, Agent, or Firm*—The Ollila Law Group LLC

(57) ABSTRACT

A cord management system operable to reduce or eliminate various forces exerted on a vacuum cleaner power cord. The system includes a swiveling strain relief incorporated into the vacuum handle and collars, used to connect sections of dirty air conduit, having exterior portions that enable the power cord to be retained in a secure manner.

5 Claims, 4 Drawing Sheets

METHOD FOR RETAINING A POWER CORD

RELATED APPLICATIONS

This application is a divisional from co-pending application Ser. No. 10/410,004 entitled, "VACUUM CLEANER CORD MANAGEMENT SYSTEM" filed Apr. 9, 2003, which is hereby incorporated by reference.

TECHNICAL FIELD

The present invention relates to cleaning devices, and more particularly, to vacuum cleaners having cord management systems.

BACKGROUND OF THE INVENTION

Many contemporary cleaning devices are electrically powered. Such devices include vacuums, buffers, extractors, steam cleaners and other similar devices. Electrical power is typically supplied to the cleaning device through a power cord. The cord is routed from the power supply to a switch provided in the handle of the cleaning device for controlling the flow of electricity to a motor in the cleaning device. For this purpose, a first power cord adapted to be plugged into a wall outlet, is routed through the handle to the switch, and a second power cord is extended from the handle and into the head of the vacuum cleaner to power the vacuum cleaner motor. Although the routing scheme described above has many benefits, it does possess some inherent drawbacks that affect the ease-of-use and reliability of the cleaning device.

One drawback to the prior art routing scheme is the attachment between the first power cord and the handle of the cleaning device. Typically, the power cord enters a void formed in the handle and attaches to a power switch. In order to protect the connection between the first power cord and the switch from being pulled apart during use, the cord is tied down before a small extension or loop formed in the first power cord. When strain is placed on the power cord during use, the tie-down resists any tugging or pulling that would separate the cord from the switch. However, this design does little to protect the cord at the handle interface. The forces exerted upon the cord during use can come from various directions. For example, if the power cord is caught under the foot of an operator the forces exerted on the cord are in a downward direction thus resulting in the power cord being pulled outward and downward from the handle. Over time, repetition of this bending results in a sustained connection between the power cord and the switch but a degradation in the outer jacket of the power cord. Degradation of the power cord can result in breach of the cord insulation and possible shorts resulting in lower product life.

Another drawback to the prior art routing scheme is the attachment between the second power cord and the handle. The prior art scheme incorporates a plug in the handle that is used to supply power from the switch to the second power cord. The second power cord is inserted into the handle plug on one end and wired to the vacuum motor on the other end. The drawback to this design is the handle plug attachment. When in use, the second power cord is subjected to various forces that can pull the second power cord from the handle plug, resulting in power interruption.

Still another drawback with the second power cord is the necessity to supply cord clips to keep the second power cord routed close to the vacuum handle. The cord clips are metal or plastic circular pieces that mount on the upper and lower sections of the vacuum handle and secure the cord against pulling or tugging free when the vacuum is in use. However these cord clips are easily damaged and require additional maintenance and expense for the user.

SUMMARY OF THE INVENTION

The invention relates to methods and apparatuses for a cord management system. In one embodiment, the apparatus includes a swiveling strain relief incorporated into the vacuum handle for protecting a power cord from the various forces exerted upon it. The strain relief can be of a single axis (wheel-type) or multi-axis (ball-type) design.

In another embodiment, the second power cord may be hardwired into the handle. Hardwiring the second power cord eliminates the possibility of the cord being pulled from its handle connection and interrupting power to the vacuum motor.

In another embodiment, collars, used to connect sections of a dirty air conduit, have exterior portions that enable the power cord to be retained in a secure manner. The collar clip can be made out of molded plastic allowing for a more robust part that is not prone to failure.

DETAILED DESCRIPTION OF THE INVENTION

Figure 1:
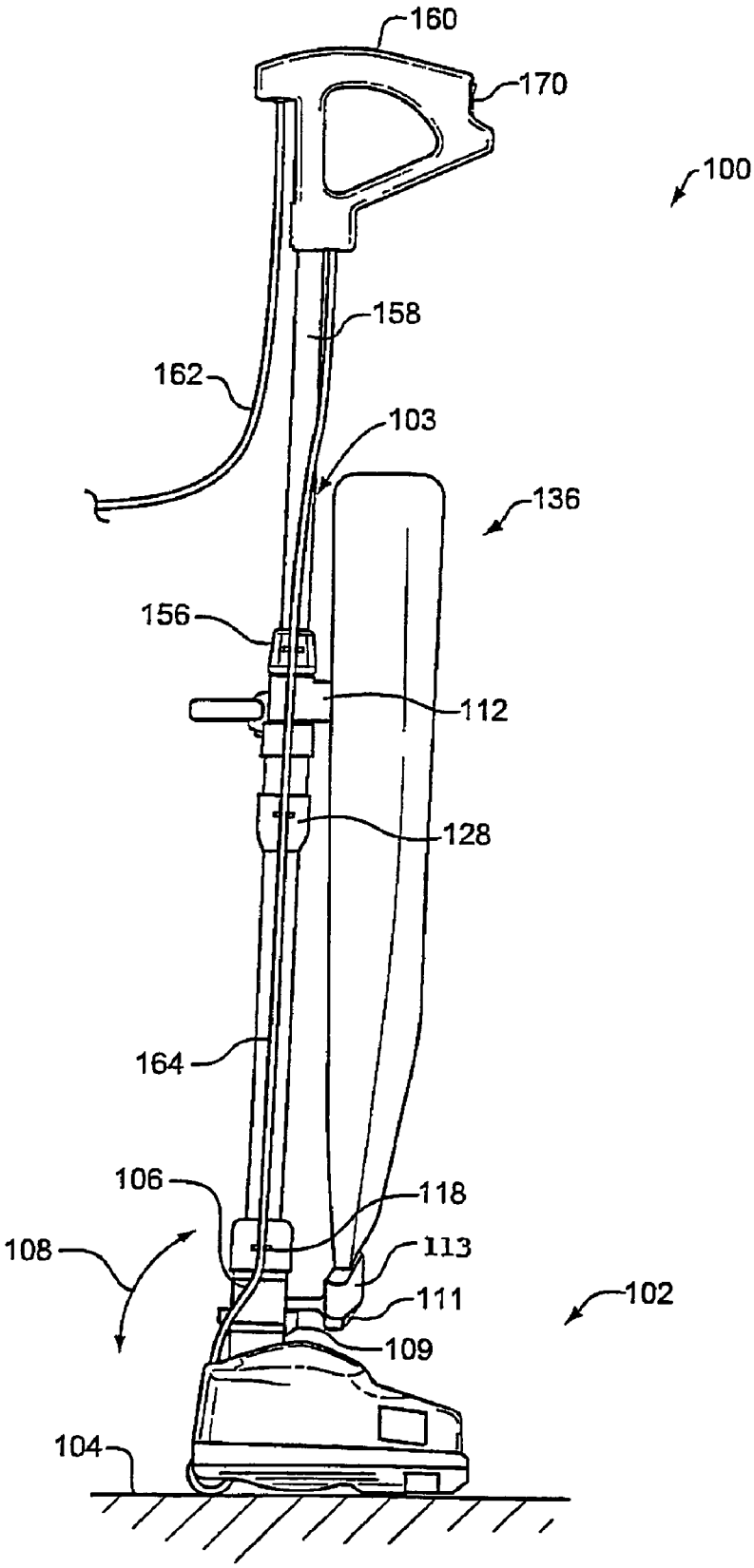
FIG. 1 is a side elevation of an upright vacuum cleaner.
Figure 2:
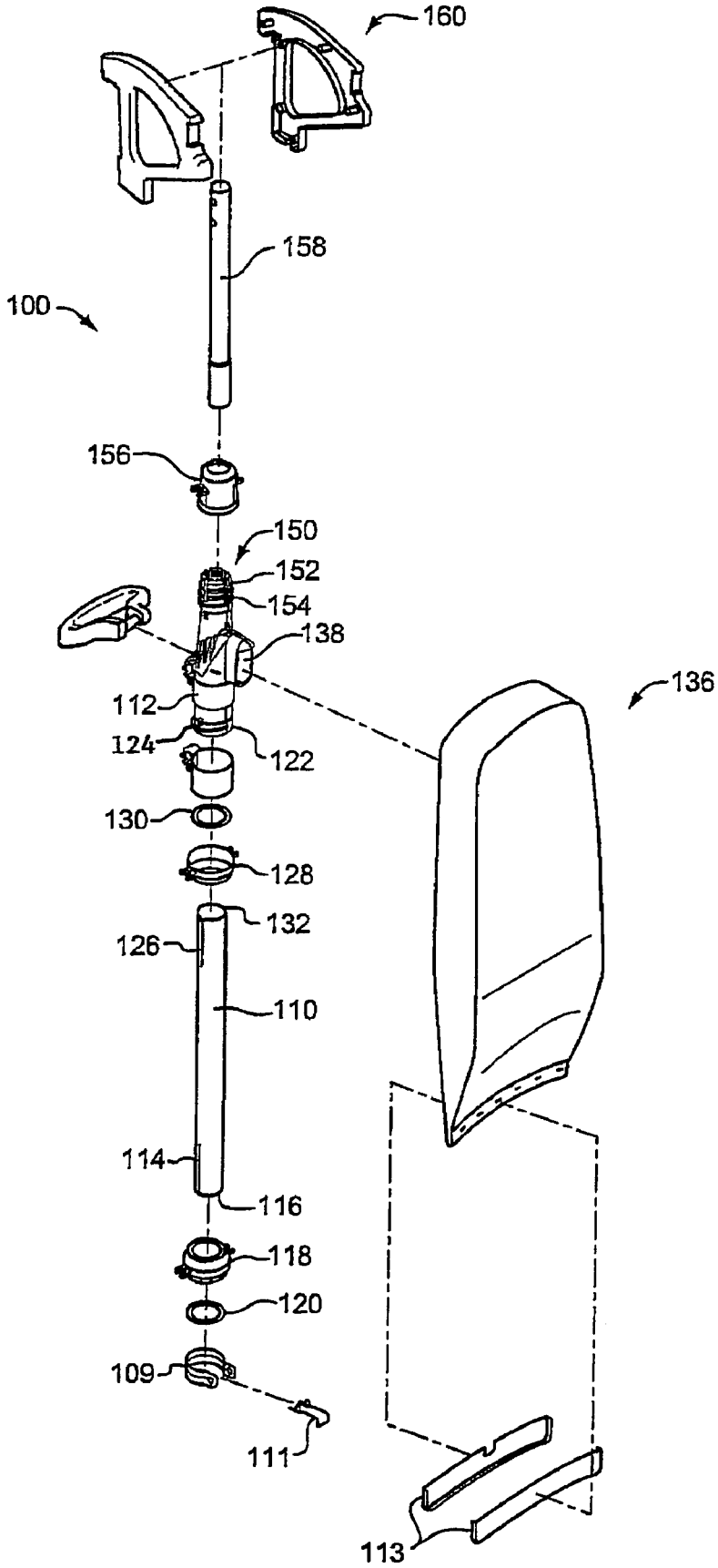
FIG. 2 is an exploded isometric view of the upper portion of the upright vacuum cleaner of FIG. 1.

FIGS. 1 and 2 are views of an upright vacuum cleaner 100 in accordance with the present invention. The vacuum cleaner 100 includes a head 102 that contains the vacuum motor and fan, a rotary brush, and other such components (not shown) that are known in the art. A handle 103 is pivotably attached to the head for maneuvering and controlling the head.

The purpose of the head 102 and its components is to provide suction at the level of the floor 104, which may be a wood floor, or may be covered with carpet, throw rugs, tile, linoleum or other floor coverings. As is well known, the air entrains particulates such as dirt, sand, lint, crumbs and other food particles, and other materials that may be found on a floor.

The particulate-laden air (dirty air) is exhausted from the head 102 via an exhaust conduit 106, which is pivotably mounted to the head to permit rotation through about 90 degrees from a generally vertical orientation to a generally horizontal orientation as indicated by the arrow 108. The particulate-laden air is transmitted upward along a dirty air conduit 110 to a dirty air exhaust duct 112. The dirty air conduit 110 of the present embodiment may be made of any of a variety of materials, such as steel or aluminum tubing, but should be sufficiently stiff to serve both as a conduit and as a portion of the handle 103 of the vacuum cleaner 100.

A clamp 109 is mounted on the exhaust conduit 106 of the vacuum cleaner 100 by known means such as screws or other fasteners. A spring clip 111 is mounted on the clamp and is adapted to clip into a slot in the bag clamp 113. The bag clamp 113 is adapted to grip the bottom of a flexible bag case 136, when the two halves thereof are assembled.

Referring to FIGS. 1 and 2, in which like elements have like numbering, the dirty air conduit 110 is maintained in engagement with the exhaust conduit 106 as follows. A slot 114 in the lower end of the dirty air conduit 110 is adapted to receive and be substantially filled by a tab (not shown) on the interior wall of the exhaust conduit 106. The tab and slot prevent the exhaust conduit 106 and dirty air conduit 110 from rotating relative to one another.

An annular shoulder may be provided in the exhaust conduit 106 to receive the bottom end 116 of the dirty air conduit 110. Such shoulder preferably has a width approximately equal to that of the wall thickness of the dirty air conduit 110. The dirty air conduit is held in place by a collar 118 and elastomeric ring 120. The collar 118 and ring 120 are adapted to slide onto the dirty air conduit 110 and the collar 118 is configured to receive the ring 120 therein.

The collar 118 threadedly engages the upper end of the exhaust conduit 106 and screws down onto it. The elastomeric ring 120 is thereby compressed between a shoulder internal to the collar 118 and the upper end of the exhaust conduit 106. The compression of the ring forces the ring 120 to expand into tight engagement with the adjacent surface of the dirty air conduit 110, which retains the dirty air conduit 110 against axial movement out of engagement with the exhaust conduit 106 in normal use.

The lower end 122 of the exhaust duct 112 includes a threaded region 124 and can be mounted to the dirty air conduit 110 in like manner to the mounting of the dirty air conduit 110 to the exhaust conduit 106. A tab (not shown) on the interior of the exhaust duct 112 is received in a slot 126 in the upper end of the dirty air conduit 110, substantially filling the slot 126. A collar 128 and elastomeric ring 130 are slid over the upper end 132 of the dirty air conduit 110, and the collar is screwed onto the lower end 122 of the exhaust duct 112, compressing the ring 130 and causing it to frictionally engage the adjacent wall of the dirty air conduit 110.

The vacuum cleaner 100 is provided with the bag case 136 into which the dirty air may be exhausted from the dirty air exhaust duct 112. The bag case 136 is made of a flexible material that is resistant to wearing and ripping, and that is either air pervious or includes vents to allow the escape of air. The bag case 136 is adapted to be mounted over the mouth section 138 of the dirty air duct 112.

The upper end 150 of the exhaust duct 112 includes a threaded section 152. A plurality of vertical slots 154 extend to the upper end of the exhaust duct 112. The threaded section 152 and the slots 154 cooperate with a collar 156 to form a collet-like connector for receiving and gripping an upper handle segment 158.

A two-piece handle (or grip) 160 for permitting a user to grip the end of the handle 103 is mounted to the upper end of the upper handle section 158 by fasteners such as screws. The two halves of the handle 160 is made of a thermoplastic material, and bonded together by known methods such as vibratory welding or use of adhesives.

A switch 170 may be provided in the handle 160 for controlling the flow of electricity to the motor in the head 102 of the vacuum cleaner 100. For this purpose, a first power cord 162 adapted to be plugged into a wall outlet may be routed through the handle 160 to switch 170, and a second power cord 164 may extend from switch 170, through handle 160 and into head 102 of the vacuum cleaner 100 to power the vacuum cleaner motor.

Figure 3:
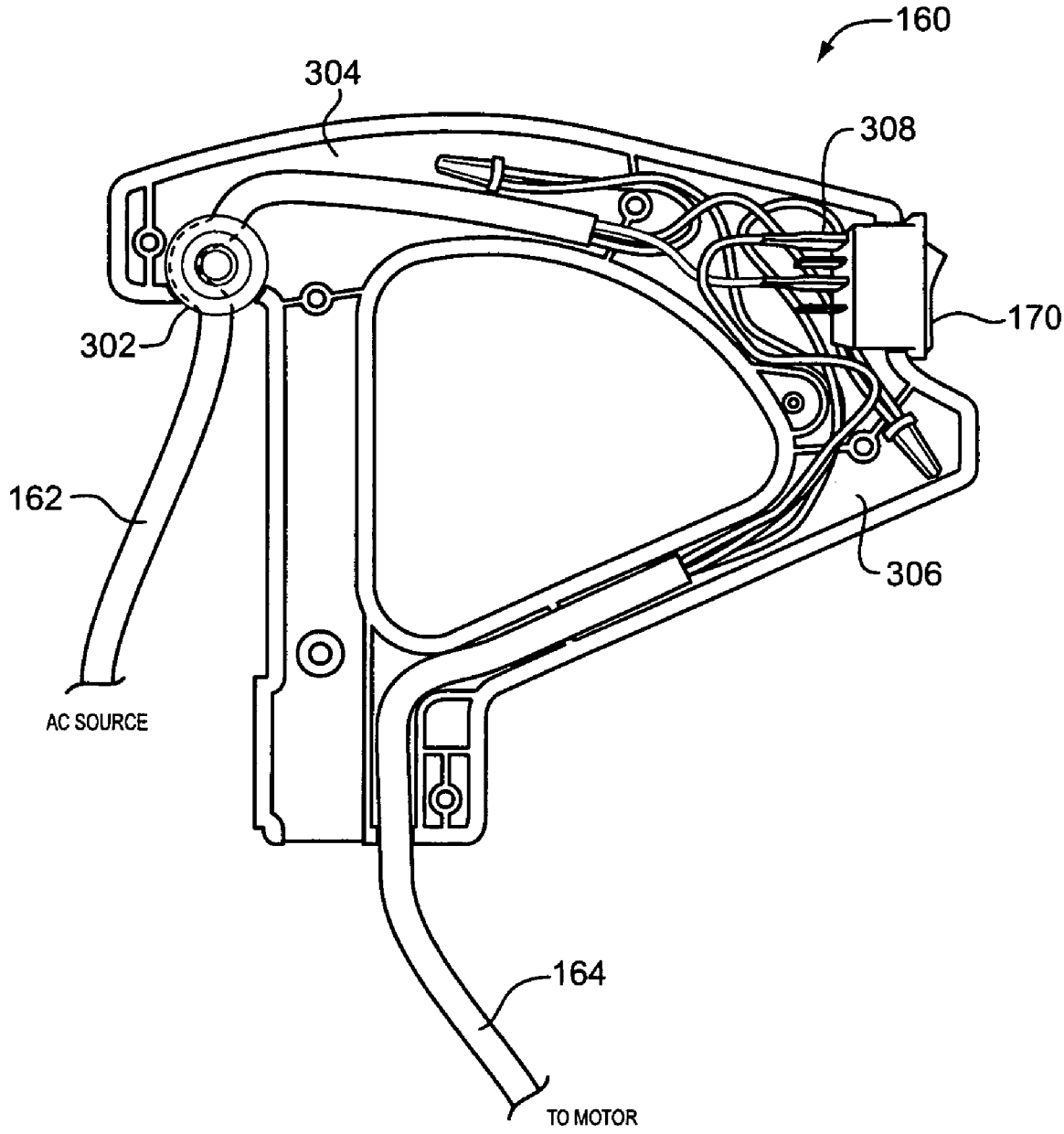
FIG. 3 is an exploded view of the handle in FIGS. 1 and 2 according to an embodiment of the invention.

FIG. 3 is an exploded view of the handle 160. Handle 160 comprises two mating halves, first power cord 162, switch 170, second power cord 164 and strain relief 302. First power cord 162 is also connected to switch 170 via power terminals 308 and routed along inlet channel 304 and through strain relief 302. Second power cord 164 is routed along outlet channel 306 and connected to switch 170 via power terminals 308.

Figure 4:
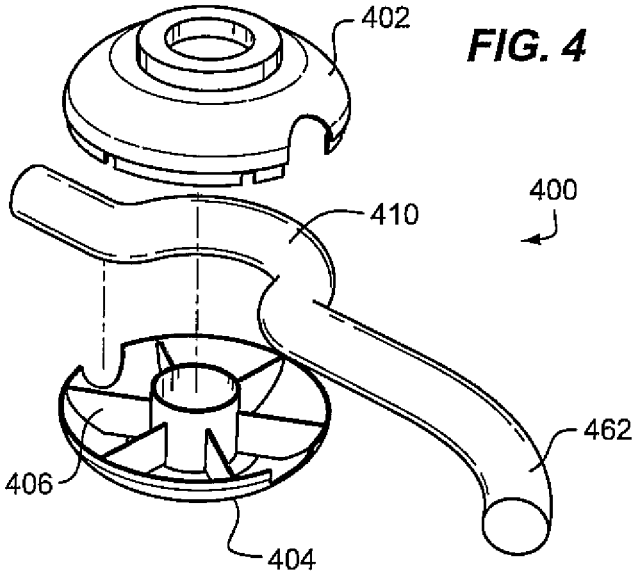
FIG. 4 is an exploded view of a strain relief according to an embodiment of the invention.

FIG. 4 is an exploded view of a preferred embodiment of a swivel strain relief. Strain relief 400 is a single axis (wheel-type) design comprised of halves 402 and 404. Power cord 462 is routed through the interior cavity 406. The interior cavity 406 is contoured to form a small passage in which a small portion 410 of power cord 462 resides, preventing strain from damaging power cord 462.

Figure 5:
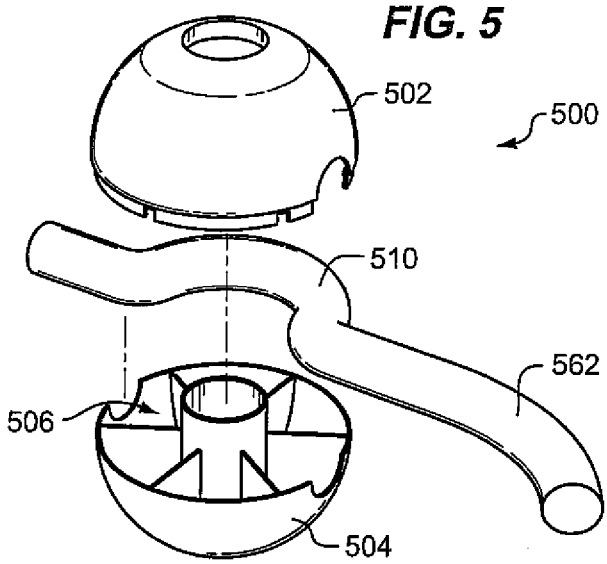
FIG. 5 is an exploded view of a strain relief according to an additional embodiment of the invention.

FIG. 5 is an exploded view of another preferred embodiment of a swivel strain relief. Strain relief 500 is a multi axis (ball-type) design comprised of halves 502 and 504. Power cord 562 is routed through the interior cavity 506. The interior cavity 506 is contoured to form a passage in which a small extension 510 of power cord 562 resides, preventing strain from damaging power cord 562.

Figure 6:
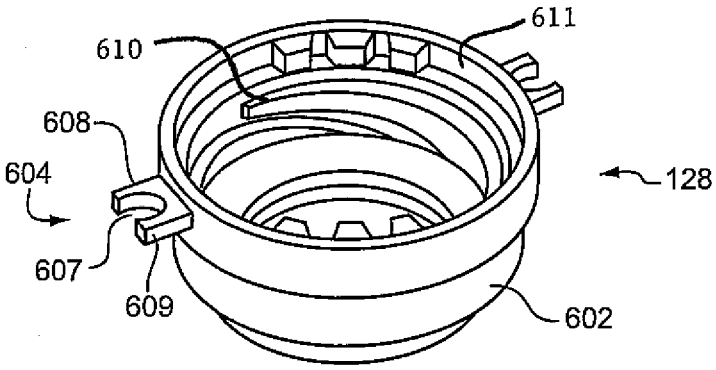
FIG. 6 is a detailed view of a collar clip according to an embodiment of the invention.

FIG. 6 is an isometric view of the collar assembly of the floor care apparatus 100 of FIG. 2. The collar 128 includes an external surface 602 having at least one retaining member 604. Retaining member 604 comprises legs 608 & 609. Legs 608 & 609 are located proximate one another such that gap 607 is formed. Gap 607 is sized as to allow power cord 164 to be held in place. Therefore, as shown in FIG. 1, a user may position a portion of a power cord, such as power cord 164 within the gap 607 of the retaining member 604. The collar 128 may also include an internal surface 611 including a threaded region 610. The threaded region 610 can be provided to threadedly engage the threaded region 124 of the exhaust duct 112, for example.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other handle and exhaust duct coupling assemblies for floor care machines, and not just to the embodiments described above and shown in the accompanying figures. Accordingly, the scope of the invention should be determined from the following claims.

What is claimed is:

1. A collar for a floor care apparatus, the collar connects and holds in place sections of conduit, said collar comprising:

an outer surface, at least one retaining member extending from said outer surface of said collar, wherein said retaining member is capable of retaining a power cord in place.

2. The collar of claim 1, farther comprising an inner surface having a threaded region to connect and hold in place at least two sections of conduit.

3. A method of retaining a power cord of a floor care apparatus, said method comprising:

providing a collar for a floor care apparatus, the collar connects and holds in place sections of conduit, wherein the collar comprises at least one retaining member extending from the outer surface of said collar, and said retaining member is capable of retaining a power cord in place; and positioning at least a portion of said power cord within said retaining member.

4. The method of claim 3, further providing the collar with an inner surface and providing the inner surface with a threaded region to connect and hold in place the sections of conduit.

5. A floor care apparatus comprising:

a power cord;

at least two sections of conduit; and a collar comprising:

an inner surface; and an outer surface, wherein said inner surface is provided with a threaded region to connect and hold in place the at least two sections of conduit and wherein at least one retaining member extends from said outer surface of said collar, wherein said retaining member is capable of retaining a power cord in place.

* * * * *

UNITED STATES PATENT AND TRADEMARK OFFICE

CERTIFICATE OF CORRECTION

PATENT NO. : 7,411,133 B2
APPLICATION NO. : 11/446902
DATED : August 12, 2008
INVENTOR(S) : Morgan et al.

It is certified that error appears in the above-identified patent and that said Letters Patent is hereby corrected as shown below:

Column 4:
Line 63 (claim 2, line 1), before "comprising" replace "farther" with -- further --.

Signed and Sealed this

Eleventh Day of November, 2008

JON W. DUDAS
*Director of the United States Patent and Trademark Office*